US005637033A

United States Patent [19]

Williams

[11] Patent Number: 5,637,033

[45] Date of Patent: Jun. 10, 1997

[54] FLAPPER WHEEL ADAPTER

[76] Inventor: Wilson Williams, 1117 W. Carpenter, Jerseyville, Ill. 62052

[21] Appl. No.: 603,368

[22] Filed: Feb. 20, 1996

[51] Int. Cl.[6] ..... B24B 41/00

[52] U.S. Cl. ..... 451/342; 451/466; 451/508; 451/509; 451/510; 411/389

[58] Field of Search ..... 457/342, 508, 457/510, 466; 411/389; 451/509

[56] References Cited

U.S. PATENT DOCUMENTS

| | | | |
|---|---|---|---|
| 1,753,377 | 4/1930 | Jackson | 451/342 |
| 3,561,173 | 2/1971 | Block | 451/466 |
| 4,237,659 | 12/1980 | Welsch et al. | 451/342 |
| 4,372,718 | 2/1983 | Zaydel | 411/389 |
| 5,299,391 | 4/1994 | Williams | 451/342 |

FOREIGN PATENT DOCUMENTS

| | | | |
|---|---|---|---|
| 663809 | 5/1963 | Canada | 451/510 |

*Primary Examiner*—Robert A. Rose
*Assistant Examiner*—George Nguyen
*Attorney, Agent, or Firm*—James E. Brunton

[57] ABSTRACT

An easy-to-use adapter assembly having a minimum number of component parts that will permit sanding flapper wheels of various sizes to be conveniently used in the field with portable hand held electric grinders of conventional design. The assembly is preferably sold as a set that includes connectors of various lengths that can accommodate drive shafts of different sizes so that the assemblage can be conveniently used in connection with flapper wheels of various thickness having spindle receiving apertures of various sizes.

6 Claims, 2 Drawing Sheets

FLAPPER WHEEL ADAPTER

BACKGROUND OF THE INVENTION

1. Field of the Invention

The present invention relates generally to adapters for use in connecting work engaging implements to drive shafts of motorized tools. More particularly, the invention concerns an improved adapter assembly for use in removably connecting a sanding flapper wheel to the drive shaft of a hand-held portable grinder.

2. Discussion of the Invention

Sanding flapper wheels of various sizes are typically used on fixedly mounted bench grinders for accomplishing a number of different types of sanding operations in the workshop. These types of sanding wheels could also advantageously be used in the field for accomplishing a number of tasks. However, the drive shafts of easily portable grinder machines, such as portable electric grinders, while able to accept thin sanding discs are typically not able to accept the much thicker sanding flapper wheels. For this reasons the use of the flapper wheels has for the most part been restricted to work which can be accomplished in the machine shop. Because a number of sanding operations can be done in a superior fashion with the flapper wheel rather than the sanding disc, a substantial need has arising for an adapter assembly that can permit interconnection of the standard, relatively wide flapper wheel with the drive shaft of the portable hand-held electric grinder.

U.S. Pat. No. 5,299,391 issued to the present inventor discloses a simple, easy-to-use adapter assembly that permits sander flapper wheels of various sizes to be operably interconnected with standard hand-held grinders. The present invention is an improvement upon the device described in U.S. Pat. No. 5,299,391.

SUMMARY OF THE INVENTION

It is an object of the present invention to provide a simple, easy-to-use adapter assembly having a minimum number of component parts that permits sanding flapper wheels of various sizes to be conveniently used in the field with portable hand-held grinders of conventional design.

Another object of the invention is to provide an assembly of the aforementioned character which is easy to use and can be sold as a set that includes connectors of various configurations so that the assemblage can be conveniently used in connection with flapper wheels of various thickness as well as those having spindle receiving apertures of various sizes.

Another object of the invention is to provide an adapter assembly that includes a uniquely configured connector member which includes a head portion, a threaded shaft portion, and an elongated diameter portion which includes a minimum number of parts and is closely receivable within the hub portion of the flapper wheels.

Another object of the invention is to provide an assembly as described in the preceding paragraphs which is durable and reliable in operation, requires the use of only a single compression washer, and one which can be inexpensively manufactured in quantity.

DESCRIPTION OF ONE FORM OF THE INVENTION

Figure 1:
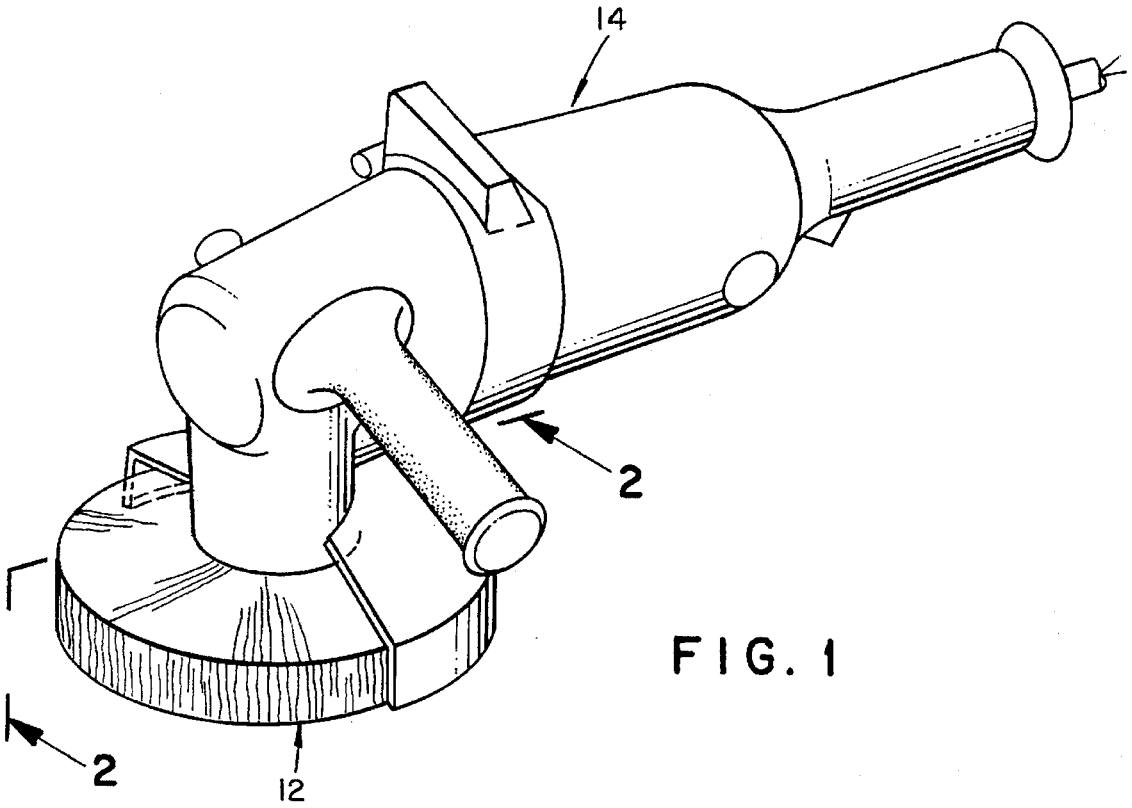
FIG. 1 is a generally perspective view of a portable, hand-held electric grinding machine to which a commercial type sanding flapper wheel has been interconnected by means of the adapter assembly of the present invention.
Figure 2:
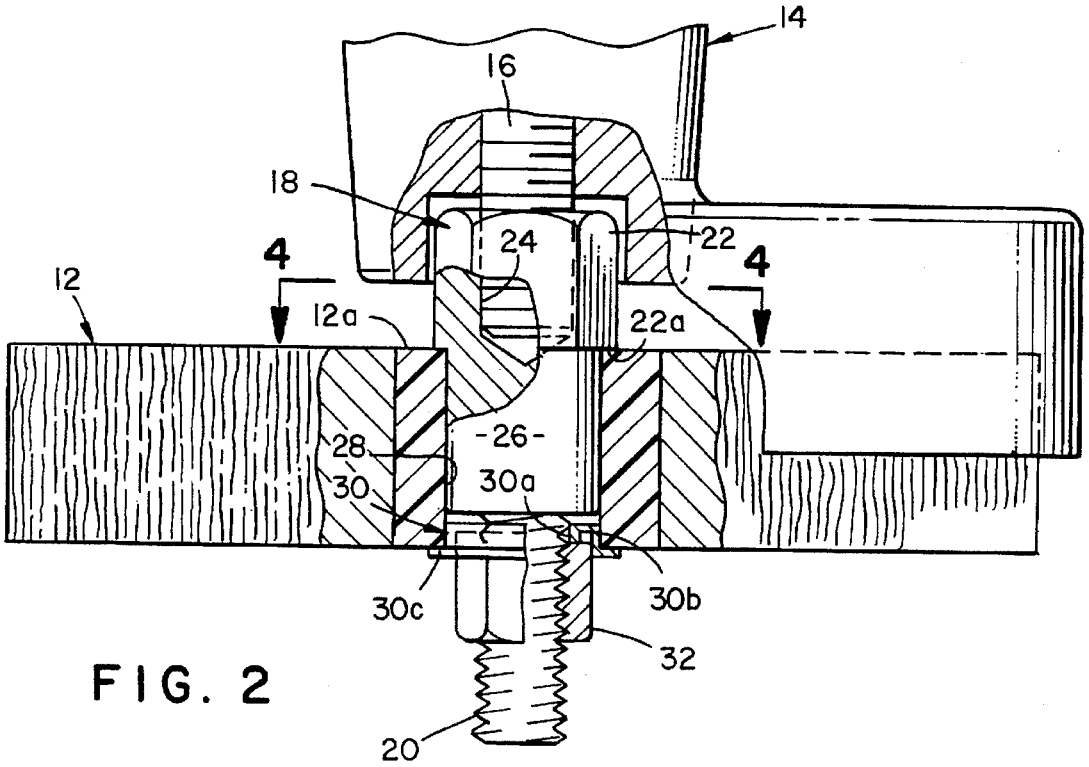
FIG. 2 is a greatly enlarged cross-sectional view taken along lines 2—2 of FIG. 1.
Figure 3:
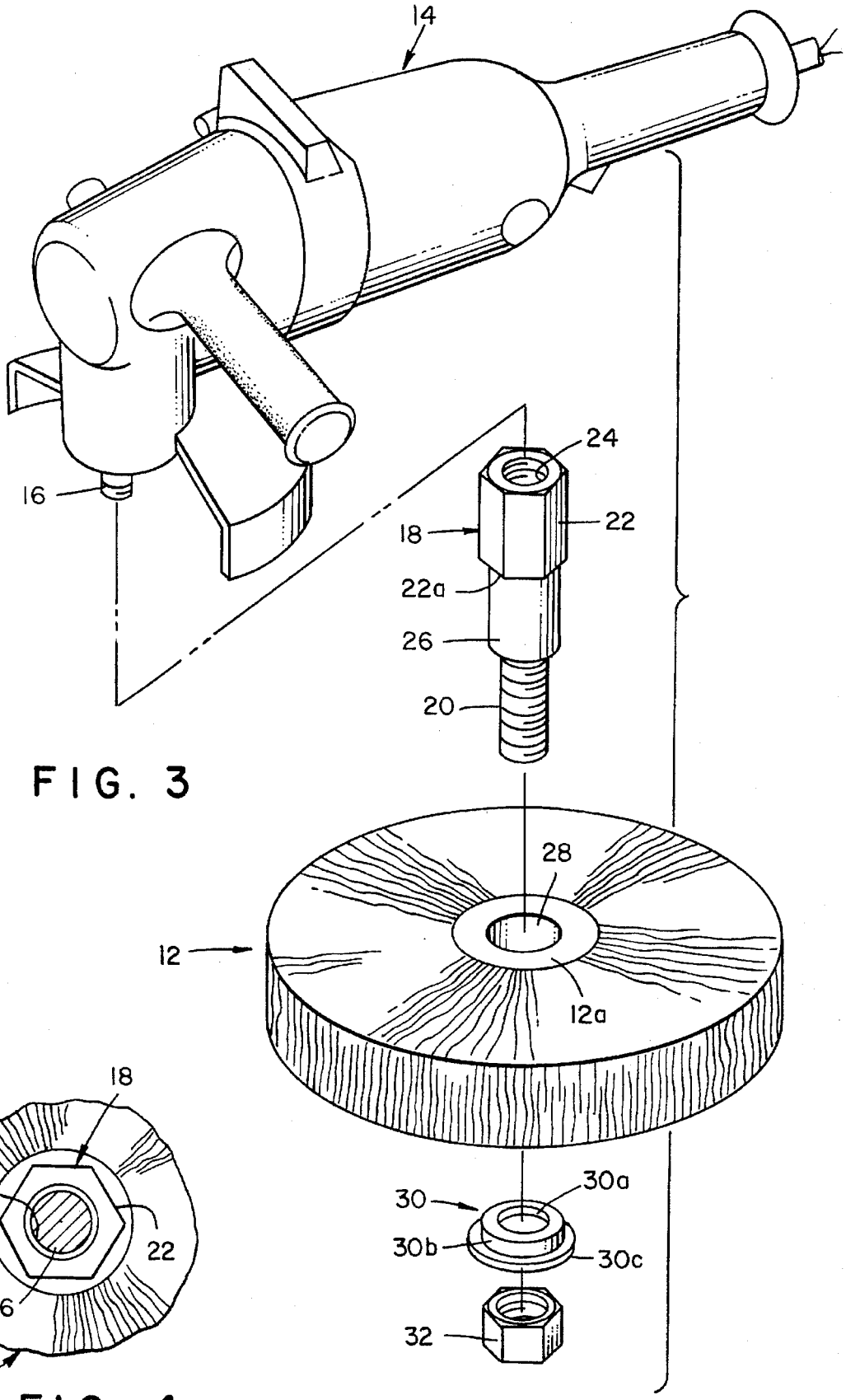
FIG. 3 is an enlarged, generally perspective, exploded view of a hand-held portable grinder showing the manner in which the adapter assembly of one form of the invention is used to connect a flapper wheel of standard design to the hand-held grinder.
Figure 4:
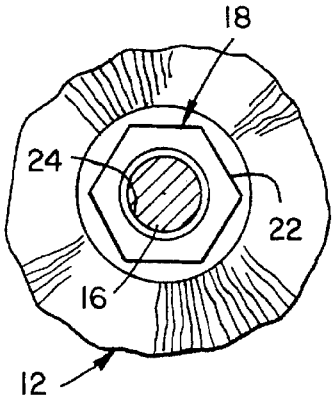
FIG. 4 is a cross-sectional view taken along lines 4—4 of FIG. 2.

Referring to the drawings and particularly to FIGS. 1, 2, 3 and 4, there shown is one form of the adapter assembly of the present invention for use in interconnecting a flapper sanding wheel 12 with a hand held, portable grinder 14 of the character having an externally threaded drive shaft 16 (FIGS. 2 and 3). The adapter assembly of the invention is usable with a number of different types of commercially available grinders including an electric grinder sold by Black & Decker Company and identified by the Serial Number 2750 and a portable electric grinder sold by Jepson Company under the Model Number 4307. Sanding flapper wheels usable with the adapter assembly of the present invention are readily commercially available in various thicknesses having arbor holes of various sizes. For example, such flapper sanding wheels are available from the Merit Company and sold are under Model Numbers 31509, 22551, and 22559.

One form of the adapter assembly of the present invention comprises a connector member 18 having an elongated, externally threaded shaft 20. Connector member 18 is also provided with a generally, hexagonally shaped head portion 22 which has an internally threaded bore 24 of a first diameter. Bore 24 is adapted to threadably receive drive shaft 16 of the portable hand grinder in the manner shown in FIG. 2. As indicated in the drawings, internally threaded bore 24 is co-axially aligned with externally threaded shaft portion 20 of the first member 18. While head portion 22 is preferably integrally formed with shaft 20 it can also comprise a separate unit which can be suitably interconnected in any appropriate manner with shaft 20.

Disposed between head portion 22 and threaded shaft portion 20 is an enlarged diameter, generally cylindrically shaped portion 26. Portion 26 is of a diameter only slightly smaller than the inside diameter of the central bore 28 provided in the particular flapper wheel that is to be used (FIG. 3). The assembly of the embodiment of the invention shown in FIGS. 2 and 3 also includes a compression washer 30 having a central aperture **30*a* adapted to closely receive shaft 20 of the member and is provided with an annular body portion 30*b* , the purpose of which will presently be described. Completing the assembly is a hexagonally shaped, internally threaded nut 32 which is adapted to be threadably interconnected with externally threaded shaft portion 20 of first member 18 in the manner shown in FIG. 2**.

As indicated in FIG. 2, when the adapter assembly of the invention is used to mount a flapper wheel 12 to the drive shaft 16 of a hand held grinder, the cylindrical body portion 26 of washer 20 is closely received within the central bore 28 of the flapper wheel to precisely center the flapper wheel relative to the longitudinal axis of connector member 18. With portion 26 of the connector member received within bore 28 of the flapper wheel, the bottom surface **22*a* of hexagonal head portion 22 of the connector engages the upper surface 12***a* of the flapper wheel proximate the central bore 28 and the threaded portion 20 of the connector extends below the flapper wheel. Threaded portion 20 also extends through the central bore 30*a* of compression washer 30 in the manner shown in FIG. 2. When the compression washer is mated with the flapper wheel, annular body portion 30*b* is closely received within the central bore 28 of the flapper wheel so as to further assist in centering the flapper wheel as nut 32 is tightened against the lower surface 30*c* of socket portion 30*b*.

The adapter assembly of the present invention is preferably sold as a kit containing at least one member 18 having a body portion 26 of a first length of, for example, ⅞th inch and at least one member 18 having a body portion 26 of second length of, for example, 1⅞th inches. Shafts 20 are typically either ⅝th inch in diameter or 10 millimeters in diameter. For certain applications, the kit may also contain a member 18 having body portion 26 of a length of 1⅜th inches and a shaft diameter of ⅜th inch.

In using the adapter assembly of the present invention, the diameter of the drive shaft of the particular tool is first determined. This done, an appropriate first member having an internally threaded bore 24 of a size compatible with the drive shaft of the tool is selected. Next, the configuration of the flapper wheel to be used is determined and an appropriate member 18 is selected which has a cylindrical body portion 26 of a diameter slightly less than the inside diameter of the central bore of the flapper wheel and a length slightly less than thickness of the flapper wheel. For example, for a flapper wheel having a thickness of about one inch a member 18 having a body portion with a length of about ⅞th inch is selected. Member 18 is then threadably interconnected with the drive shaft 16 of the portable grinder. Next, the flapper wheel is then inserted over the shaft portion 20 as is the compression washer 30. Finally, the hex nut 32 is interconnected with the outboard end of shaft 20 of member 18 and is snugged down into the socket of the lower compression washer in the manner shown in FIG. 2 so that the flapper wheel is accurately centered and securely clamped in position.

Similarly, for a flapper wheel having a thickness of about 1½ inches, a member 18 having a body portion with a length of not less than 1⅜th inches is selected and for a flapper wheel having a thickness of about 2 inches a member 18 having a body portion of notless than about 1⅞th inches is selected. When the flapper wheel is correctly assembly with member 18, enlarged diameter portion 26 of member 18 as well as the outer surface of annular body 30*b* of washer 30 is closely received within the central bore of the flapper wheel. For flapper wheels which have central bores of different diameters, appropriately configured members 18 and washers 30 are selected to insure that a correct assembly is formed wherein the flapper wheel is both precisely centered relative to the shaft of the grinder and is securely connected thereto.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An adapter assembly for use in interconnecting a sanding wheel having a central bore and a thickness with a hand-held portable grinder of the character having an externally threaded drive shaft, comprising:

(a) a connector member having:

(i) an externally threaded shaft;

(ii) a head portion spaced apart from said threaded shaft, said head portion having an internally threaded bore of a first diameter which is co-axially aligned with said externally threaded shaft for threadably receiving the drive shaft of the grinder; and (iii) an elongated body portion disposed intermediate said head portion and said threaded shaft, said elongated body portion being closely receivable within the central bore of the sanding wheel and having a length less than the thickness of the sanding wheel;

(b) a compression washer having a circumferentially extending flange for engaging the sanding wheel and a central aperture for receiving said externally threaded shaft of said first member; and (c) a nut for threadable engagement with said externally threaded shaft.

2. An assembly as defined in claim 1 further including a second connector member having an externally threaded shaft and a head portion having an internally threaded bore of a second diameter.

3. An assembly as defined in claim 1 in which said elongated body portion of said connector member is generally cylindrical in shape.

4. An assembly as defined in claim 1 in which said head portion of both said connector member is hexagonal in cross-section.

5. An adapter assembly for use in interconnecting flapper sanding wheels of the type normally used with a bench grinder and having first and second widths and first and second central bores with a hand-held portable grinder of the character having an externally threaded drive shaft, comprising:

(a) a first connector member having:

(i) an externally threaded shaft, having a first length;

(ii) an integrally formed, generally hexagonally shaped head having an internally threaded bore of a first diameter co-axially aligned with said shaft for threadably receiving the drive shaft; and (iii) an elongated body portion disposed intermediate said head portion and said threaded shaft, said elongated body portion having a first length and a first outside diameter;

(b) a second member having:

(i) an externally threaded shaft having a second length;

(ii) an integrally formed, generally hexagonally shaped head portion having an internally threaded bore of a second diameter co-axially aligned with said shaft for threadably receiving the drive shaft; and (iii) an elongated body portion disposed intermediate said head portion and having a second length and a second outside diameter;

(c) compression washer having a socket portion and a flat surface portion for engaging the sanding wheel and a central aperture for receiving said externally threaded first and second shafts of said first member; and (d) a nut for threadable engagement with said external threaded first and second shafts.

6. An assembly as defined in claim 5 in which said body portion of said first and second members are closely receivable within the central bores of the flapper sanding wheels.

* * * * *